United States Patent [19]

Inglis et al.

[11] Patent Number: 4,867,357

[45] Date of Patent: Sep. 19, 1989

[54] JETTISONABLE PROTECTIVE COVER DEVICE

[75] Inventors: Ronald T. Inglis, Laguna Beach; Thomas W. Bastian, Placentia; Charles W. Schertz, Bakersfield, all of Calif.

[73] Assignee: General Dynamics Corp., Pomona Division, Pomona, Calif.

[21] Appl. No.: 135,210

[22] Filed: Dec. 21, 1987

[51] Int. Cl.[4] ..... F42B 19/46

[52] U.S. Cl. ..... 244/121; 102/293; 102/377

[58] Field of Search ..... 244/121; 102/377, 378, 102/293; 89/1.809, 1.81

[56] References Cited

U.S. PATENT DOCUMENTS

| | | | |
|---|---|---|---|
| 2,556,672 | 6/1951 | Bergh et al. | 85/32 |
| 2,653,504 | 9/1953 | Smith | 85/1 |
| 2,815,698 | 10/1957 | Burrows . | |
| 2,871,750 | 2/1959 | Parrish | 85/32 |
| 2,883,910 | 4/1959 | Nessler | 89/1.5 |
| 3,119,298 | 1/1964 | Brown | 85/1 |
| 3,196,746 | 7/1965 | Dahl | 89/1 |
| 3,362,290 | 1/1968 | Carr et al. | 102/378 |
| 3,559,928 | 2/1971 | Dohmeyer | 241/121 |
| 3,601,055 | 8/1971 | Crockett | 102/377 |
| 3,637,166 | 1/1972 | Nicholson et al. | 244/121 |
| 3,674,227 | 7/1972 | Jacobson et al. | 244/121 |
| 3,675,533 | 7/1972 | Gawlick et al. | 89/1 B |
| 3,706,281 | 12/1972 | Hatakeyama | 102/378 |
| 3,902,400 | 9/1975 | Kincheloe et al. | 89/1 B |
| 4,275,859 | 6/1981 | Bleday | 244/121 |
| 4,593,637 | 6/1986 | Klee | 102/293 |
| 4,714,020 | 12/1987 | Hertsgaard et al. | 102/377 |
| 4,753,169 | 6/1988 | Shores | 102/293 |

*Primary Examiner*—Sherman D. Basinger
*Assistant Examiner*—Thomas J. Brahan
*Attorney, Agent, or Firm*—Neil F. Martin; Leo R. Carroll

[57] ABSTRACT

An in-flight jettisonable protective cover device for protecting fragile, accurate, radomes or signal-responsive components for the major portion of a flight which is capable of being jettisoned in one piece at supersonic speeds from a guided missile, other air vehicles, or space vehicles. The cover device is for use, for example, in combination with a guided missile having a shell structure, a nose portion, and a radome in the missile nose. The cover device is attached to the missile nose for covering the radome such that an inner space is defined. A plurality of shear pins or other quick-release mechanisms attach and retain the cover device to the missile shell. A source of low pressure gas pressurizes the inner space to approximately 50 psi. A rapid-discharging, high pressure gas cartridge produces a high pressure gas for exerting a pressure force on the aft face of the cover device. The pressure forces are sufficient to shear the retaining pins and accelerate the cover device sufficiently forward to clear the missile body at supersonic speeds. The missile angle of attack creates lateral aerodynamic forces on the cover deivce to clear it from the missile. The sensitive radome can then be used for high precision detection and tracking as required at intercept.

7 Claims, 2 Drawing Sheets

JETTISONABLE PROTECTIVE COVER DEVICE

BACKGROUND OF THE INVENTION

1. Field of the Invention

This invention relates in general to a protective covering for radomes or uncovered signal-responsive components which are integral with air or space vehicles and more specifically, involves a cover device which may be jettisoned during supersonic flight.

2. Background of the Invention

For aerodynamic reasons it is desirable to have a pointed nose on a guided missile and other flight vehicles. However, and by way of example, it has been found that guided missiles utilizing an antenna looking through a pointed radome experience error slope. Small radome error slopes at launch or for mid-course guidance may not be critical. However, error slope is particularly harmful when high precision is required such as at intercept.

This is particularly true with high altitude performance of radio frequency guided missiles.

A highly functional radome, i.e. one that is radiation transparent, would be a thin, hemispherical dome of glass or similar material. However, such a radome provides high drag. Additionally, the radome is subject to rain erosion, insect impingement, rocket or turbojet motor exhaust, optical contamination, ice formation, general debris, humidity, heat, salt, sand, dust and the like. Also, the radome is subject to general physical damage during transportation, storage, loading, and firing.

Therefore, it is desirable to have an aerodynamic protective cover device for radomes or signal-responsive components which is suitable for launch and for mid-course guidance, and which is jettisonable when high precision is required at intercept.

It is further desirable that such a protective cover device be jettisonable in such a manner that the vehicle and radome or signal-responsive components are not damaged.

SUMMARY OF THE INVENTION

This invention is a jettisonable protective cover device in combination with a guided missile, in this example, having either a radome or uncovered signal-responsive components in the missile nose. The jettisonable cover device, for example, generally comprises a generally ogive-shaped structure capable of separating in one piece from the missile during supersonic flight. The cover device attaches to the forward section of the missile and covers the exemplary radome such that an inner space is defined. A plurality of shear pins attach the aft end of the cover device to the missile shell. Various other quick-release mechanisms can be used in place of the shear pins. A low pressure gas source is valved to pressurize the inner space to approximately 50 psi. A high pressure gas source furnishes high pressure gas to a cavity adjacent the aft end of the cover device. In response to a signal, the high pressure gas source provides gas to the cavity at approximately 2000 psi. This pressure force on the aft flange face is sufficient to shear the plurality of shear pins (in this example) and accelerate the cover device forward. The force from the pressurized inner inter-dome gas continues this acceleration and escapes out the aft opening. Lateral aerodynamic force is created by a slight pitching movement or angle of attack, to accelerate the cover device laterally in relation to the missile. These lateral aerodynamic forces will produce a lateral displacement sufficient for the jettisoned cover device to safely clear the missile before drag and return it to the missile.

Other features and many attendant advantages of the invention will become more apparent upon a reading of the following detailed description together with the drawings, wherein like reference numerals refer to like parts throughout.

DETAILED DESCRIPTION OF THE INVENTION

Figure 1:
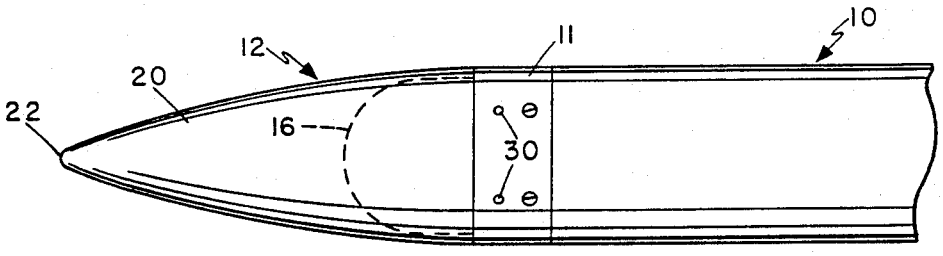
FIG. 1 is a side elevation view of the nose portion of a typical guided missile incorporating a jettisonable cover device.

With reference now to the drawing and more particularly to FIG. 1 thereof, there is shown the forward section of a guided missile, shown generally as 10, having a nose portion 12. A cover device 20 of the present invention is shown in this example as an ogive-shaped structure which is attached as an integral part of the missile 10. The position of an exemplary missile radome 16 is shown in phantom lines In most applications, the cover device 20 and the radome 16 would be transparent to electromagnetic radiation. Depending upon the desired utilization, the cover device 20 could be made of such materials as ceramic, fused silica, fiberglass, pyroceram or various metals and alloys or mixtures thereof. Radomes, such as radome 16, may be made from ceramic, fused silica, fiberglass or pyroceram materials which are fabricated having dielectric qualities which make the material transparent to radio-frequency energy. An infrared dome or the like can be substituted for, or integrated with, the radome 16. Infrared domes may be manufactured from materials such as sapphire, germanium, silicon, quartz or calcium aluminate; such materials being transparent to infrared radiation. For some uses, such as in the vacuum of space, for example, a radome may not be utilized to shield signal-responsive components such as a radio frequency antenna, an infrared seeker, an environmental survey system, a solar cell device, or a laser device, for example. In such cases, an inner-space would be created between the cover device and the signal-responsive component(s) which would be sealed from the rest of the vehicle.

Figure 5:
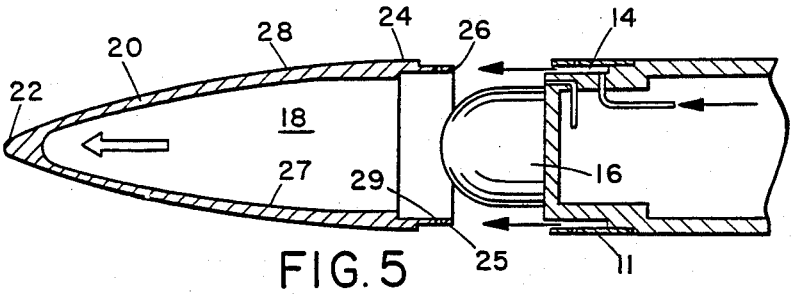
FIG. 5 illustrates the final jettison action.

As best seen in FIG. 5, cover device 20 has a general nose-cone configuration with a generally pointed front end 22, open aft end 24, and inner and outer surfaces 27, 28. Rearwardly extending aft flange 25 on aft end 24 terminates in face 26. Shear pin bore 29 through aft flange 25 is used to secure the cover device 20 to the missile 10.

Figure 2:
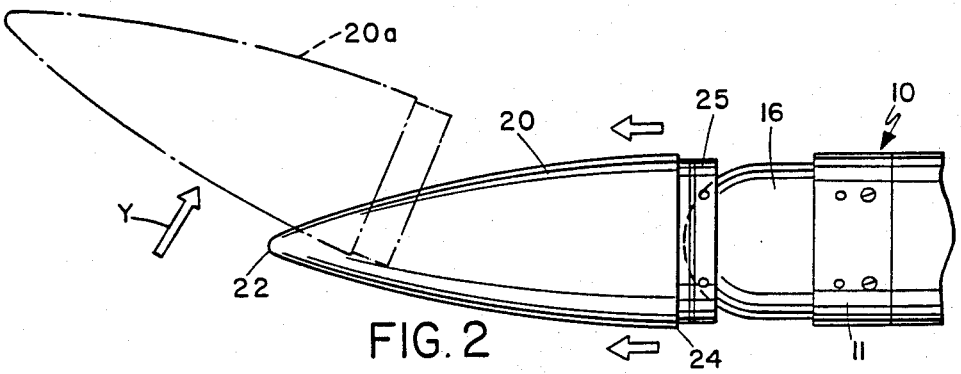
FIG. 2 is a similar view showing the jettison action of the cover device.

FIG. 2 is a view similar to FIG. 1 showing the jettison action of the cover device 20 from the missile 10. As will later be explained more fully, the gasses jettison the cover device from missile 10. An exemplary trajectory for cover device 20 is illustrated as 20*a*, with arrow "X" depicting the pitching moment factors and arrow "Y" illustrating the side of lateral load.

Figure 3:
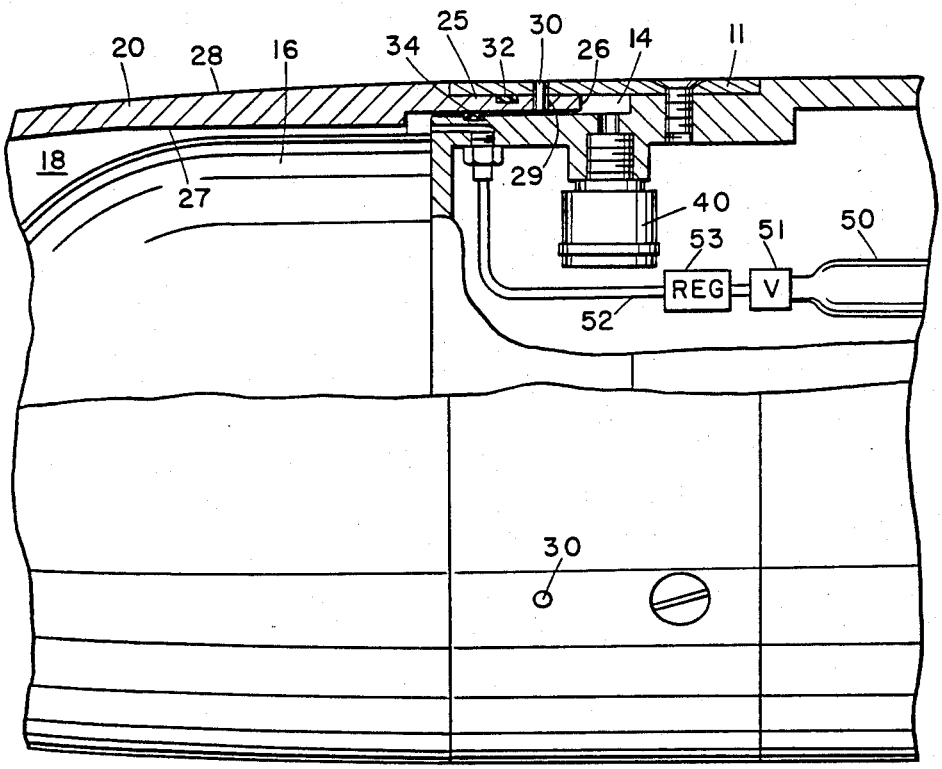
FIG. 3 is an enlarged side view, partially cut away, of the junction of the cover device with the missile body.

With reference now to FIG. 3, there is shown an enlarged side view, partially cut away, of the connecting section of cover device 20 with the missile 10 and the jettison mechanism. Missile 10 includes shell structure 11 defining a forward facing annular cavity 14 for accepting aft flange 25. Aft flange 25 is inserted in the cavity 14 leaving a rear portion of the cavity 14 unoccupied. Retaining means, such as a plurality of shear pins 30, pass through shell 11 and attach and retain cover device 20 to missile 10. A high pressure gas source, such as a gas generator cartridge 40, is connected to the high pressure cavity 14. Cartridge 40, when actuated by well-known solenoid means (not shown) or pyrotechnic means (not shown), for example, generates high pressure gas which is vented to cavity 14. Sealing means, such as outer O-ring 32 and inner O-ring 34 seal high pressure cavity 14 and prevent high pressure gasses from escaping past aft flange 25. A low pressure gas source, such as cylinder 50, provides gas for pressurizing an inner space 18. Cylinder 50 may be actuated by well-known solenoid means or pyrotechnic means (neither shown), for example. To conserve space, cylinder 50 contains gas at much higher pressure than the desired end pressure in the inner space 18. Valve 51 releases the pressure from cylinder 50 to a regulator 53 which regulates the gas to the desired end pressure and low pressure line 52 delivers low pressure gas to the inner space 18.

Figure 4:
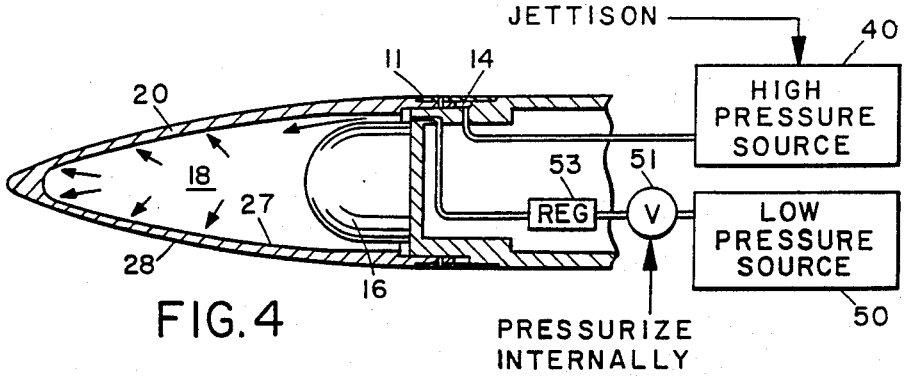
FIG. 4 illustrates the initial stage for ejecting the cover device.

FIG. 4 illustrates the initial stage for ejecting the cover device 20 during flight. To effectively jettison the cover device from missile 10, sufficient forward energy must be imparted to the cover device to overcome the wind drag forces to move the cover device forward clear of the radome 16. Lateral forces on outer cover device 20 must then create a trajectory causing the cover device to clear all missile appendages.

Figure 6:
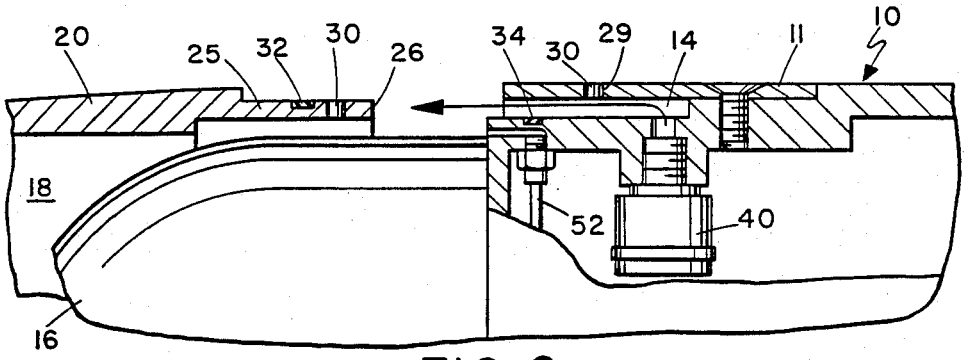
FIG. 6 is a view similar to a portion of FIG. 3 showing the separation of the cover device from the body.

As seen in FIGS. 3 and 4, the forward forces are provided by a low pressure source, cylinder 50, for pressurizing the inner space 18, and a high pressure source 40 for pressurizing high pressure cavity 14. Regulator 50 lowers the gas pressure from the low pressure source 50 to the desired end-pressure in the inner space 18. Thus, the gasses exert two forces on cover device 20 relative to missile 10. The first force from the pressurized volume is equal to the pressure multiplied by the cross-section area of cover device 20. A pressure of 50 psi has been found to be sufficient for this purpose. This pressure is not sufficient to shear pins 30 or to damage radome 16. Therefore, timing is also not a major problem in this regard, and the inner space 18 may be pressurized relatively slowly. The second forward force on cover device 20 is provided by the high pressure gas introduced into cavity 14 from cartridge 40. The second forward force is equal to the pressure of high pressure gas in cavity 14 multiplied by the area of face 26. These forces are sufficient to shear the plurality of shear pins 30 retaining the cover device 20 to the missile. Cartridge 40 is designed to very quickly pressurize cavity 14 to achieve the high pressure force. Therefore, immediately upon release of the high pressure gas from cartridge 40, pins 30 shear and the cover device 20 is accelerated forward and separates from missile 10 as shown in FIG. 6. Once rear flange 25 is clear of cavity 14, the relatively small volume of high pressure gas bleeds off the larger volume of low pressure gas in space 18 continuing the acceleration of cover device 20. The gas exits out the aft opening, also providing acceleration.

Once the cover device has passed forward clear of the radome 16, lateral wind forces provide a trajectory for clearing all parts of the missile. The lateral wind forces may be produced by a pitch rate or angle of attack of the missile. To achieve this, the missile is maneuvered so that it is developing the desired number of G's. A small angle of attack of approximately 2 degrees or larger has been found to be sufficient to provide adequate lateral aerodynamic forces to clear the jettisoned cover device 20 clear of missile 10.

A series of eleven tests were conducted in a supersonic wind tunnel with full scale models. Velocities of Mach 3.8 to 4.6, inter-dome pressure of 25 to 50 psi, and pitch angle of 2 to 8 degrees were used. The test demonstrated successful separation trajectory of the cover device 20 at supersonic speeds and indicated that the cover device would clear all parts of the missile including dorsals, tails, etc., during its separation trajectory.

From the foregoing description it is seen that the present invention provides many advantages over the prior art.

A major advantage of the present invention is the substantial reduction in missile total drag for the major portion of the flight.

Another major advantage includes the ability for onboard cooling of a radome and/or signal-responsive components. This can be provided by circulating cooling gas or liquid between the dome and the low drag nose. The cover device can be constructed of quite strong material to protect the radome and/or signal-responsive components and shield them from such forces as aerodynamic heating, rain erosion, insect impingement, rocket or turbojet motor exhaust, optical contamination, ice formation, general debris, humidity, heat, salt, sand, dust and the like encountered during flight and from general damage during shipping, storage, and handling.

During flight the cover device 20 will protect the fragile radome and/or signal-responsive components from aerodynamic heating and large drag loads when the missile is operating a high velocity, high dynamic pressure, and high maneuverability.

The foregoing is a complete description of an exemplary embodiment of a jettisonable protective cover device which is constructed with the principles of this invention. It is likely that changes and modifications will occur to those skilled in the art which are within the inventive concepts disclosed or claimed herein. Accordingly, the present invention is to be construed as limited only by the spirit and scope of the appended claims.

We claim:

1. In combination with a missile having a shell structure, a nose, and signal-responsive components in the missile nose; a cover device capable of separating in one piece from the missile during supersonic flight attached to the missile nose and covering the signal-responsive components said cover device comprising a one-piece, integral shell having a closed front end and an aft end having a face;

retaining means for attaching and retaining said cover device to said missile to define an enclosed inner space between the missile nose and front end of the cover device; and jettison means responsive to an actuating force for jettisoning said cover device in one piece from said missile during supersonic flight.

2. The combination of claim 1 wherein said jettison means includes:

low pressure jettison means including low pressure gas source means including a low pressure gas for introducing said low pressure gas into said enclosed inner space such that a first forward force is exerted on said cover device.

3. The combination of claim 2 wherein said jettison means includes high pressure jettison means for exerting a second forward force on said cover device such that said retaining means are overcome, and said first and second forces combined, separate said cover device from the missile.

4. The combination of claim 3 wherein said high pressure jettison means includes high pressure gas source means for providing a high pressure gas for exerting a pressure on said aft face of said cover device.

5. The combination of claim 4 wherein said missile shell at said nose defines a forward facing annular cavity; and said aft end of said cover device includes a rearwardly extending annularly aft flange including said face; said flange for partial insertion into said cavity; the remainder of said cavity for receiving said high pressure gas from high pressure gas source means so that said second forward force is exerted on said face of said flange.

6. The combination of claim 5 wherein said retaining means is a shear pin joining said aft flange and said shell structure.

7. The combination as claimed in claim 1, wherein said jettison means includes:

storage means for low pressure gas in said missile;

connecting means for supplying low pressure gas from said storage means to said enclosed inner space in said cover device; and control means for controlling the supply of low pressure gas to said inner space.

* * * * *